United States Patent [19]

Benjamin

[11] Patent Number: 4,991,756

[45] Date of Patent: Feb. 12, 1991

[54] GLOVE AND MITTEN DRYER

[76] Inventor: John R. Benjamin, 1010 - 92nd St., Niagara Falls, N.Y. 14304

[21] Appl. No.: 319,115

[22] Filed: Mar. 6, 1989

[51] Int. Cl.[5] ..... D06C 5/00; D06F 59/04

[52] U.S. Cl. ..... 223/72; 223/78; 223/74; 223/80

[58] Field of Search ..... 223/3, 24, 52, 25, 61, 223/66, 73, 74, 78, 79, 80, 85, 72

[56] References Cited

U.S. PATENT DOCUMENTS

| | | | |
|---|---|---|---|
| 2,146,109 | 2/1939 | Curtis | 223/66 |
| 2,177,546 | 10/1939 | Johnson | 223/66 |
| 2,704,176 | 3/1955 | Smith | 223/25 |
| 2,786,615 | 3/1957 | Saibene | 223/61 |
| 4,602,389 | 7/1986 | Brown | 223/74 X |

FOREIGN PATENT DOCUMENTS

| | | | |
|---|---|---|---|
| 2111381 | 7/1983 | United Kingdom | 223/85 |

*Primary Examiner*—Werner H. Schroeder
*Assistant Examiner*—Paul C. Lewis
*Attorney, Agent, or Firm*—Wallace F. Neverlin

[57] ABSTRACT

A device is taught for drying wet gloves or mittens or for drying portions of other wet clothing having inside openings therein which are substantially circular in cross-section and which are of a depth of at least about three inches. The device is a hollow cylindrical dryer or is slightly tapered from cylindrical to slightly conically shaped. The main portion of the dryer between its ends preferably consists of a grid of many square or diamond shaped ventilation holes to facilitate evaporation of moisture. The dryer can be made of flexible plastic material and molded into its final shape (and also into such a shape that a number of said dryers can be "nested" inside each other); or the dryer can be molded in an essentially planar condition and then forced by the user into its shape described above, by slight exertion of hand pressure.

8 Claims, 2 Drawing Sheets

GLOVE AND MITTEN DRYER

BACKGROUND OF THE INVENTION

There are many groups of people who in the course of their work and/or in their recreational activities wear gloves and mittens and who frequently get them very wet while wearing them. Firefighters, construction workers, electric company linesmen, skiers, hunters, fishermen, hikers, typical adults and children are all examples of people who often wear gloves and get them wet and must find satisfactory means of drying their gloves and mittens. Such persons also often get the sleeves of their jackets very wet particularly at the ends of the sleeves near their wrists and desire satisfactory means of fast and efficiently drying these areas of their jackets so that they are dry and comfortable to get into when they next go to wear them again.

The dryers of the present invention are designed to overcome the foregoing problems and to accomplish same with a unique and inexpensive device for doing so.

FIELD OF THE INVENTION

The invention relates to the fast and efficient drying of articles of clothing, or parts of articles of clothing as more particularly described herein. Most specifically the invention relates to the fast and efficient drying of gloves and mittens by the use of a novel device to be inserted therein as more fully described hereinafter.

DESCRIPTION OF RELATED ART

A search of the prior art carried out in the Patent Office confirms, it is believed, that, before the present invention, no one previously had invented a drying device having the uniqueness and universality of application possessed by the drying devices of the present invention.

The following patents were located:

| U.S. Pat. No. | Inventor | Issue Date | Title |
|---|---|---|---|
| 606,628 | J. S. Hull | 6/28/1898 | Glove Drier |
| 2,783,925 | A. Ross | 3/5/1957 | Glove Drier |
| 4,084,733 | F. Perlmutter | 4/18/1978 | Glove Form |
| 4,689,897 | G. Marsalona | 9/1/1987 | Composite Glove Drying Device |

Specifically, the search was directed to a plastic mesh-like cylindrically or conically shaped unit that could be inserted into the inside "neck" of the glove or mitten (or sleeve) and allow air to circulate to remove the moisture and thus dry the glove and/or its lining.

It is to be noted and acknowledged that the drying of gloves is an old problem but what is noticeable is that all patents found provide for individual finger outlines on the dryers of same, while, as will be clear from the description that follows, the device of the present invention does not.

The earliest dryer patent, to Hull, is a wire form with finger and thumb outlines.

The Ross patent shows the use of a rigid plastic form with an adjustable thumb.

The Perlmutter patent discloses a plastic shape to be inserted into the glove to be dried, (typically a golf glove) but possesses a configuration considerably different from the dryers of the present invention as described hereinafter.

The Marsalona patent shows the combination of a dryer unit with something else, e.g. a bottle for liquid contents or a clamp for attachment to a golf bag.

However, none of these patents either singly or in combination with any of the others teaches or suggests a dryer device having the essential features of the dryers of the present invention.

OBJECTS OF THE INVENTION

It is an object of the present invention to dry wet gloves and mittens and other articles of clothing such as wet sleeves of jackets in a relatively rapid and efficient manner.

A further object is to accomplish the foregoing through the use of a dryer of novel configuration.

A further object is to provide such a dryer which can be inexpensively manufactured and which can be warehoused and stocked for sale, or for use or for re-use requiring only a minimum of storage and display space.

A further object is to provide such a drier which can easily be inserted into the article to be dried and also easily removed therefrom after it is dried.

These and other objects will be made clearer when considering the following detailed specification taken in conjunction with the appended drawing figures.

SUMMARY OF THE INVENTION

In its essence, the instant invention describes a hollow cylindrical dryer form, or slightly tapered from cylindrical to slightly conically shaped. The ends of the dryer form typically have a solid ring all the way around. One end, the larger diameter (if slightly conically shaped) preferably has a tab with a hole in it for hanging the dryer such as by an elongated wire "S" hook. The main portion of the dryer between its end preferably consists of a grid of many square or diamond shaped ventilation holes to facilitate evaporation of moisture.

BRIEF DESCRIPTION OF THE DRAWING FIGURES

Figure 2:
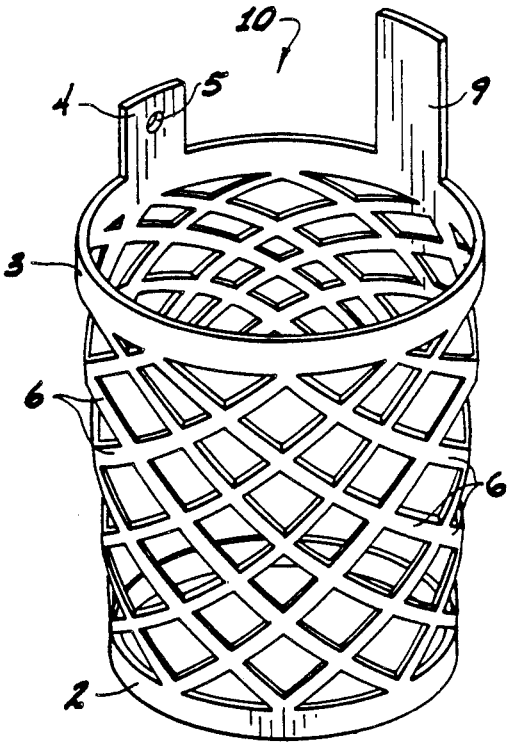
FIG. 2 is a prespective vertical view of a preferred embodiment of the device of the present invention, wherein the main portion of the dryer between its ends consists of a grid of many diamond shaped ventilation holes to facilitate evaporation of moisture.
Figure 3:
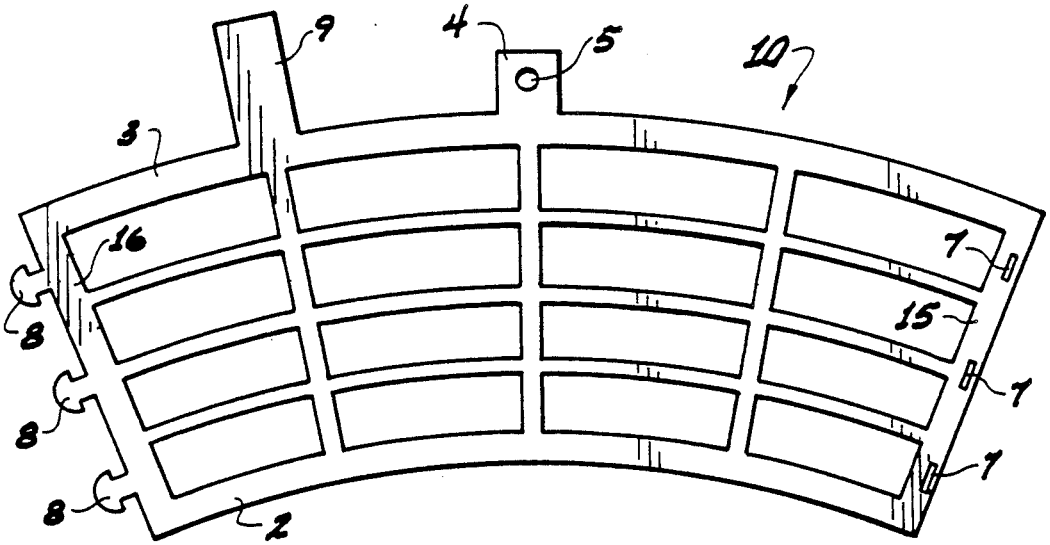

FIG. 3 ia also a perspective vertical view of a preferred embodiment of the device of the present invention, but wherein the device is in its unused, substantially planar shape, i.e. the shape it is in after being manufactured and when stored or displayed, or the shape it is in after having been used and when stored for re-use. The main portion of this dryer between its ends also consists of a grid of many ventilation holes, but these being essentially rectangular or square as compared with the diamond shaped holes of the dryer of FIG. 2.

FIG. 4 is a vertical perspective view of a device of the present invention as it might be used in one of the inventions variations to dry a mitten or glove.

DESCRIPTION OF THE PREFERRED EMBODIMENTS

Referring to the drawings now in more detail, wherein like reference numerals refer to like elements throughout the various drawing Figures, reference numeral 10 is directed to the dryer according to the present invention.

Figure 1:
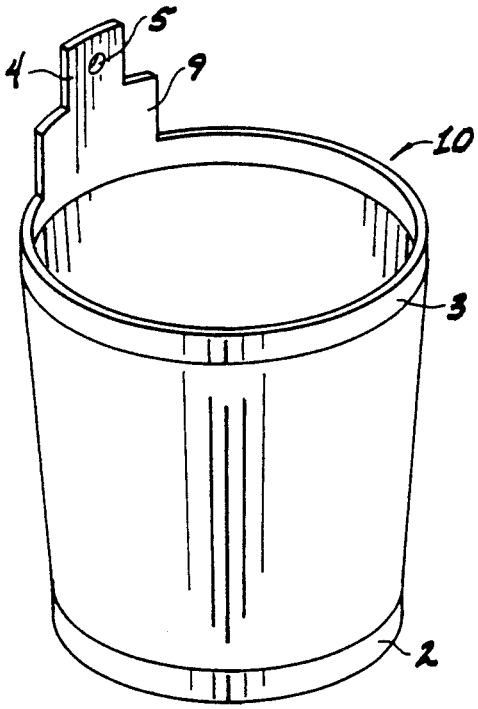
FIG. 1 is a schematic vertical view of the device showing its typical configuration.

The dryer of FIG. 1 has solid rings 2 and 3 entirely surrounding the circumference of the dryer at the bottom and top thereof respectively, the dryer being tapered slightly in decreasing cross-sectional area vertically as it goes from the top to the bottom.

The dryer can be made of flexible plastic material and molded in the shape as shown, so that a number of said dryers can be placed in a single box by nesting them inside each other; or the dryer can be molded in an essentially planar condition and then forced by the user into the substantially cylindrical shape shown, by slight exertion of hand pressure. The flexibility and re-flexibility of many plastic materials now commercially available on the market make this possible and the particular plastic or other flexible type material that might be used in its place do not constitute an essential part of this invention. Not shown in FIG. 1 but typically also present are means on the outer or inner circumference of the dryer for clasping or gripping together the abutting vertical faces of the dryer as it is forced by the user into the shape shown. The dryer will typically also have a tab 4 with a hole 5 in it for hanging the dryer after it has been inserted into the wet article, e.g. mitten or glove to be dried.

The dryer typically will have dimensions (but not limited to) such as the following:

Rings 2 and 3, each ¼" in height;
Overall height, 3 inches to 4 inches.
Diameter of narrow bottom end, 2⅛".
Diameter of larger top end 2½".
Height of tab 4, ½ inch.
Thickness of plastic material, 1/16".

These dimensions are typical for non-heavy duty or dress adult gloves. Dimensions of the dryer are of course not critical but are variable depending on the size of the gloves to be dried and other possible factors such as their weight and/or how wet they are, etc. .

The dryer is inserted, narrow end first if of slightly tapered configuration, into the opening i.e. the "neck" of a glove or mitten and hung vertically by the hook, near a hear source, if possible. This allows the moisture to evaporate and escape through the wrist opening of the glove or mitten.

FIGS. 2 and 3 have already been discussed as to the features they typically possess that are common to the device of FIG. 1; and also as to their particular type of ventilation holes. It should now be added as to FIG. 2 that the outer surface of the grid matrix 6 can typically be produced so that the surface is slightly coarse so that it can engage more strongly frictionally with the inside of the glove to be dried than it could if its surface were smooth. This is also true of the outer surface of the lattice like dryer of FIG. 3.

Instead of a tab 4 with a hole 5 therein, the dryer can be molded with an integral tab in question mark like shape in order to hang the drier. Also, an additional tab 9 could be integrally molded with the device at the top thereof to provided for the user's name or identification thereon.

An additional feature of the dryer (see FIG. 3) which is sometimes utilized is one or more slit (s) 7 on one of the sides 15 or 16 of the dryer to accommodate the insertion(s) therein of one or more locking tab(s) 8 on the other circumferential side of the dryer. Tab(s) 8 can easily twisted to engage in or to disengage from slit 7. such tabs and slits may be used to keep the device in its cylindrical or slightly conical shape.

sometimes the above feature is not desired or desirable. For example, sometimes it may be preferable to utilize a material of construction, plastic or other, that is highly flexible, i.e. one that is easily compressed into a smaller diameter and one that readily returns to a circumference of larger diameter. With such a material it may be preferable to leave a gap between the ends or sides 15 and 16 of the dryer down the full length thereof. The use of such a material would allow a dryer of the same size to fit different size gloves and mittens due to its compressability and its flexibility. It would put tension on the glove, causing a better grip with little or no slipping while the glove was drying.

In such an embodiment of the invention the outer surface of the device would be flexed into a substantially circular cross-sectional area all along its length but only to such an extent that the vertical sides or edges 15 and 16 do not meet. However, the circular like area along the length of the device would preferably be more than 270° , i.e. more than ¾ of a circle shape but less than the completed 360° circular cross-sectional shape along its length. Such an alternative is illustrated in FIG. 4 wherein the dryer 10 has been compressed by the user to a degree that its sides 15 and 16 were near to abutting, the dryer was then inserted into the neck 11 of the mitten 12 and then the dryer was permitted to return to the larger diameter with the gap shown between the sides 15 and 16.

SUMMARY OF PRODUCT USAGE, BENEFITS AND ADVANTAGES

The dryer is inserted (narrow end first) into a glove or mitten and hung vertically, near a heat source if possible. This allows the moisture to evaporate and escape through the wrist opening of the glove or mitten. A smaller size dryer can be made for children's gloves and mittens. Gloves with non-porous outside surfaces would dry faster than when the dryer is not used. Leather and woolen gloves would dry with less shrinkage. The dryer can be used by everyone who exposes their gloves and mittens to moisture and require overnight or between shift drying.

The dryer facilitates more rapid and complete drying of gloves and mittens as compared to laying them out flat or hanging by clothes pins. It would not rust or stain gloves or mittens. Sets of dryers of different colors would be used to keep matching pairs of gloves or mitten easily identified, especially for small children. The dryer would also be inexpensive and relatively easy to manufacture, package, ship and store. The use of the dryer also facilitates the drying of apparel overnight without the use of expensive to operate, home clothes dryers; also, some materials cannot withstand the high temperatures of clothes dryers.

In sum, the dryer drys gloves and mittens faster and more evenly; reduces shrinkage; helps to identify pairs; is easy to store when not in use by sliding one dryer inside another (stackable or nestable).

The gloves and mittens would be ready more quickly for next use; gloves less likely to be miss-matched; size of glove or mitten would stay close to original size.

Specific groups of people who could use the idea are: Firefighters, construction workers, electric company linemen, all people who work outside in inclement weather, skiers, hunters, fishermen, hikers, home owners, children; almost everyone, at one time or another.

Having thus described the invention, it should be apparent that numerous structural modifications and adaptations may be resorted to without departing from the scope and fair meaning of the instant application as described here and above and as claimed here and below.

What is claimed is:

1. A device for drying wet articles of clothing, the clothing having a shape of substantially tubular form having an inside surface and having a length of at least three inches; the device consisting of a single sheet of flexible plastic material capable of being bent into a tubular shape when inserted into the tubular article and further having outer and inner surfaces, said sheet of material further having means for allowing ventilation of air therethrough when inserted into said tubular article and whereby the outer surface of the device contacts the inner surface of the tubular clothing.

2. The device of claim 1, when inserted into the tubular clothing, forms a substantially circular arc of less than 360°.

3. The device of claim 1 having side edges and means on said side edges for connecting the same together.

4. A device according to claim 1 wherein the outer surface of the drying device consists of grid matrix of many square or diamond shaped ventilation holes.

5. A device for drying wet articles of clothing, the clothing having a shape of a substantially tubular form with an inside surface, said device consisting of a sheet of flexible plastic material having lateral edges with one edge being shorter than the other one and further having opposed edges with means for connecting the same together, whereby, when the opposed edges are connected together a frustrum is formed having open ends; said sheet of material further having means for allowing ventilation of air therethrough when inserted into sand tubular article, the frustrum shape of said device further allowing a multiple of said devices to be nested within each other.

6. A device according to claim 5 wherein the outer surface of the drying device consists of a grid matrix of many squares or diamond shaped ventilation holes.

7. A device according to claim 4 wherein the outer surface of the grid matrix is slightly coarse and engages more strongly frictionally with the inside of the article of clothing being dried than if the outer surface was smooth.

8. A device acccording to claim 6 wherein the outer surface of the grid matrix is slightly coarse and engages more strongly frictionally with the inside of the article of clothing being dried than if the outer surface was smooth.

* * * * *